United States Patent [19]

Riegelman et al.

[11] 4,237,560

[45] Dec. 9, 1980

[54] BIDET SYSTEM AND WATER TANK THEREIN

[75] Inventors: Harry M. Riegelman, Fullerton; Anthony C. Paganelli; John A. Walker, both of Northridge; Norris Borden, Mission Hills; Stephen A. Lawhead, Arleta; Harry M. Umann, Los Angeles, all of Calif.

[73] Assignee: Rusco Industries, Inc., Los Angeles, Calif.

[21] Appl. No.: 973,907

[22] Filed: Dec. 28, 1978

[51] Int. Cl.[3] ..... E03D 9/08; A47K 3/22; F24H 1/00

[52] U.S. Cl. ..... 4/7447; 219/306; 219; 4/420.2 331

[58] Field of Search ..... 4/6, 7, 145, 146, 179; 219/306, 331; 222/397, 206

[56] References Cited

U.S. PATENT DOCUMENTS

| | | | |
|---|---|---|---|
| 711,827 | 10/1902 | Cook | 219/306 |
| 3,154,793 | 11/1964 | Congdon | 4/7 |
| 3,370,454 | 2/1968 | Flores | 219/331 |
| 3,873,808 | 3/1975 | Patton | 219/331 X |
| 3,995,326 | 12/1976 | Umann | 4/7 |
| 4,028,745 | 6/1977 | Caniglia | 4/7 |
| 4,062,071 | 12/1977 | Blanquet | 4/7 |
| 4,068,116 | 1/1978 | McKinstry | 219/331 X |
| 4,123,807 | 11/1978 | Oguma et al. | 4/7 |

*Primary Examiner*—Stuart S. Levy
*Attorney, Agent, or Firm*—Perry E. Turner

[57] ABSTRACT

There is disclosed a bidet seat housing in which are front and rear water jet nozzles and director members through which to pass water one or the other of the nozzles via a solenoid-operated diverter valve connected to the outlet fitting on top of an elongated horizontal water tank adjacent one end thereof, such tank having its inlet fitting on top adjacent the other end connected to a water supply line via a solenoid-operated pressure regulator. An external mode selector effects operation of one of either one of the solenoids or of a warm air blower for supplying warm air blower at the rear of the seat. The water tank contains a heater and a sensor with a temperature sensitive resistor. A control module has circuitry of which the sensor resistor is a part, and effects operation of the heater as needed to maintain water flowing through the tank at the desired temperature. Maintenance of such temperature is effected by construction of the inlet fitting so that it injects water into the top of the tank adjacent its inner surface and parallel to its axis towards the outlet end, and of the outlet fitting having an air escape opening adjacent the inner surface of the tank. A pressure switch operable from weight on the seat must be closed to permit any operations, and an over-temperature thermal switch on the tank stops the system when water temperature exceeds a predetermined level.

6 Claims, 11 Drawing Figures

FIG. 2
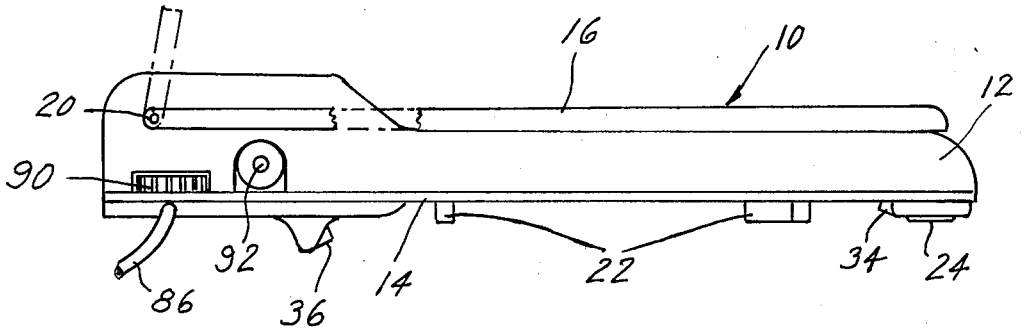
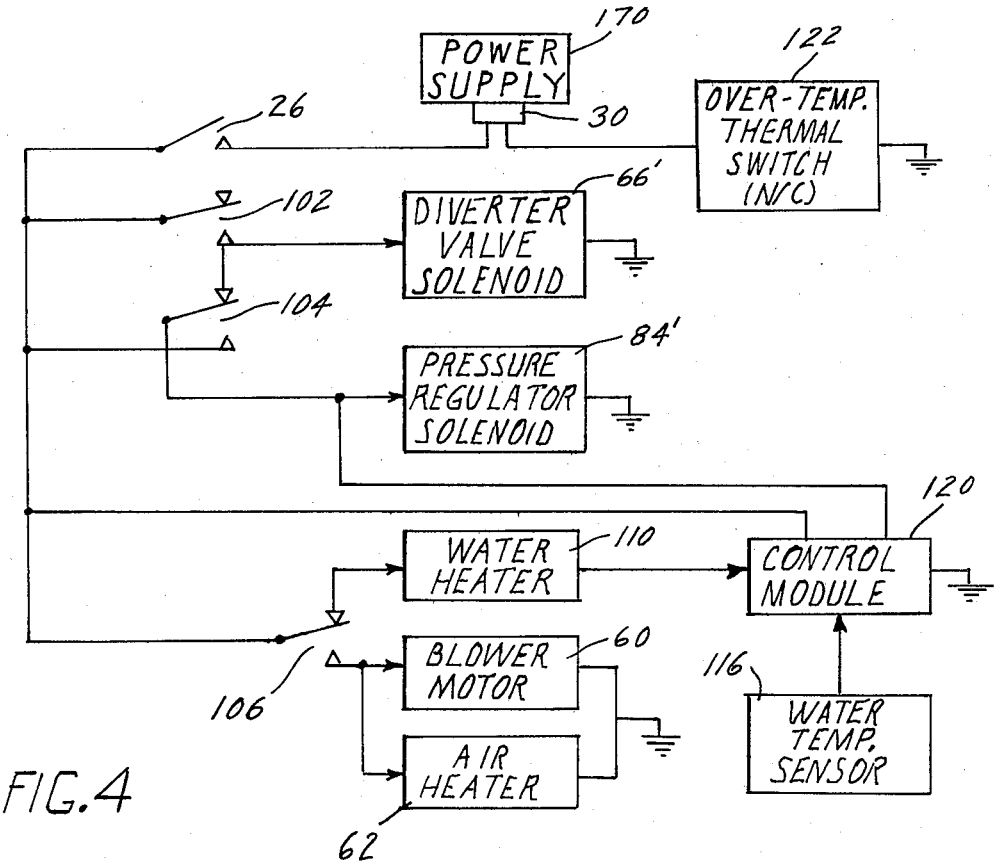
FIG. 4

BIDET SYSTEM AND WATER TANK THEREIN

BACKGROUND OF THE INVENTION

1. Field of the Invention

This invention relates to bidet systems and to water tanks suitable for use therein.

2. Description of the Prior Art

Considerable time, effort and expense have been devoted to the development of water handling systems in which water flowing through a confined space is to be heated and maintained at a predetermined temperature. Thus, in a bidet of the type wherein water handling apparatus is housed in the restricted space of a toilet seat housing, the water tank must necessarily be quite small, particularly since such space also houses various other items such as a blower with motor and fan, a pressure regulator, water jet nozzles, tubing, diverter valve, and solenoids together with circuits for controlling various electrical operations including the heating of the water via a heating element therein. It is also known that for a bidet to stand a chance to receive wide acceptance so that it can be made and sold in volume, it is essential that the temperature of the water directed against the skin of the user must be maintained at a comfortable level. In this regard, common failings of previously known bidets include undesirable and uncomfortable temperature variations, known as "hot shots" and "cold shots", during water flow delivered to the user.

SUMMARY OF THE INVENTION

This invention embraces an elongated horizontal tank with a cylindrical interior, a high power heater extending through the ends of the tank, top mounted inlet and outlet fittings adjacent its ends, the inner end of the inlet fitting being closed and having an opening adjacent such closed end and such fitting being oriented to position the opening adjacent the inner surface of the tank and facing the outlet end with its axis parallel to the tank axis, the outlet fitting having an opening through its wall into its interior that is located adjacent the inner surface of the tank to facilitate purging of air at the top of the tank upon initiation of water flow, such fittings and the openings therein coacting during heating of water to effect motion of the water so that the temperature of the water at the top of the tank is the same as that of the water at the bottom or center or any other location in the tank. This invention also embraces such a tank with a sensor and control network in circuit with the heater and sensor to effect heater operation so as to maintain water temperature substantially constant. Also embraced is a bidet formed of a toilet seat housing such tank and network together with a pressure regulator through which to supply water to the inlet fitting at a selected pressure, a diverter valve connected to the outlet fitting and operable from the exterior of the seat to direct water to one or the other of fore and aft j5t nozzles fpr directing water towards the user at selected angles, an air blower and heater for directing warm air to the user from the rear of the seat under control of the exterior mode control. Further, this invention embraces a master pressure switch for preventing any bidet operations when there is not force on the seat, and a normally closed over temperature thermal switch exposed to the tank interior and operable to close down all operations upon the internal temperature reaching a predetermined high level, such thermal switch being nonresettable before repair operations occur.

BRIEF DESCRIPTION OF THE DRAWINGS

FIG. 2 is a side elevation view of the seat;

FIG. 4 is a combined schematic and block diagram to aid in explaining the operations of the parts shown in FIG. 1;

DESCRIPTION OF PREFERRED EMBODIMENTS

Figure 1:
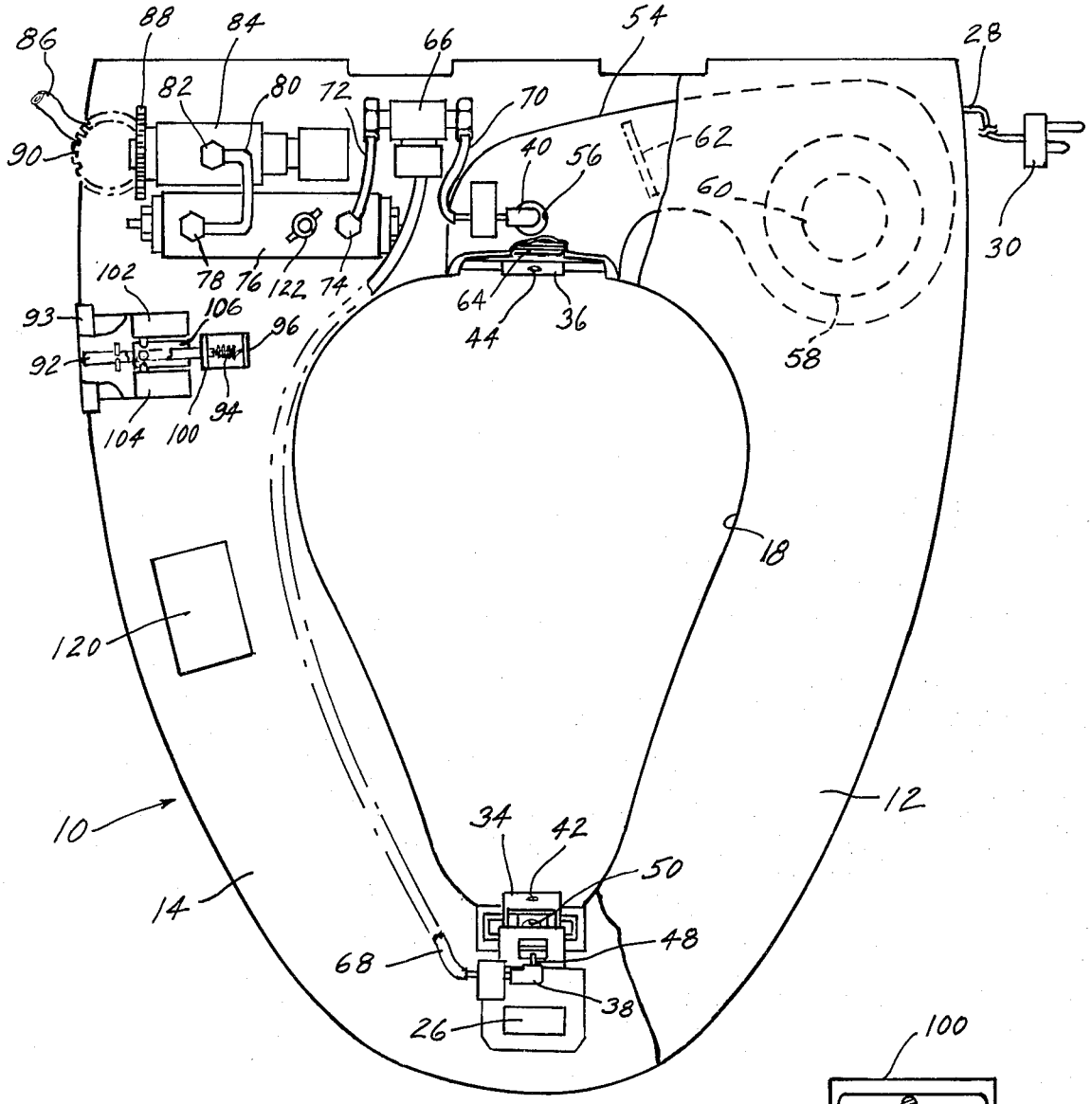
FIG. 1 is a top plan view of a toilet seat bidet system, with the top partly broken away to show the base and the placement of parts thereon.

Referring to FIGS. 1 and 2, a bidet 10 is shown in the form of a toilet seat which serves as the housing for the parts of the bidet system. Such housing comprises an upper seat portion 12 secured to a base 14. As shown in FIG. 2, a lid or cover 16 may be provided to cover the opening 18 in the seat when the bidet is not in use, such cover being pivotally mounted at 20 to the rear portion of the seat. The base 14 is provided with a number of spaced bumpers 22 on which the unit rests on the top of the toilet bowl (not shown).

The base 14 is also provided with a pressure pad 24 that engages the top of the toilet bowl, and via such pad 24 the weight of a person on the seat 12 actuates and closes a normally open pressure switch 26. As will be seen, closure of the pressure switch 26 is neccessary for any bidet operations, because the pressure switch is in series with the power source via a power cord 28 and plug 30.

The bidet 10 as illustrated has fore and aft water director members 34, 36. The members 34, 36 receive water that emerges in a stream from jet nozzle structures 38, 40, and directs water thus received through openings 42, 44 along the longitudinal centerline of the seat opening 18. As will be seen with reference to the front portion of the base 14, the lower end of the nozzle 48 extending from the nozzle structure 38 is spaced above the inlet portion of the director member 34, and water jetting from the end of the nozzle 48 traverses the air gap to the member 34 and enters an enlarged opening 50 therein. The vertical distance between the end of the nozzle and the opening 50 is one inch. Between the inlet opening 50 and the outlet opening 42 of the member 34, the opening through the member is smooth and conically tapered throughout the curvature of such opening between the surfaces at which the openings 50, 42 are located. In one example, such surfaces are at right angles, i.e., the bore between the openings 50, 42 is conical and curves 90°. As for the nozzle 48, it preferably terminates in a straight bore of a length at least equal to four times the size of its bore, to achieve an unfeathered stream of water across the air gap. The member 34 may be angularly adjustable, and by virtue of the conical bore therein the entry of the unfeathered water stream into the center of the opening 50.

As will be noted for the front air gap, the nozzle 48 is positioned forward of the member 34, and hence is directed at a downward, rearward angle to the opening 50. For the rear member 36, the nozzle structure 40 is positioned so the end of the nozzle extending therefrom (not shown) is vertical and directly above the center of the enlarged opening in the member 36. The bore in the member 36 is shaped like that in the member 34, and the member 36 is similarly adjustable if desired.

The rear jet nozzle structure 40 is supported above a blower housing 54, and the vertical nozzle extends into the housing 54 through an opening 56 therein. The blower has a fan 58 driven by a motor 60, and a downstream heater 62 for delivering heated air past the rear of the seat through the end of the housing 54. Desirably, the outlet end of the housing 54 is normally closed by miniature featherweight louvers 64 which are pivotally supported in the sides of the blower housing 54, and which are balanced to function as airfoils which are moved to open position by the force of the heated air and cause the air to be directed upwardly towards the user at a desired angle of elevation, e.g., 10°. As will be seen, blower operation cannot occur while there is movement of water through the system.

The application of water to one or the other of the fore and aft nozzles is controlled in accordance with the condition of a solenoid-operable diverter valve 66. In one arrangement, flexible tubes 68, 70 are connected from respective outlet ports of the valve 66 to the inlet ends of the nozzle structures 38, 40. Water enters the valve 66 through a connection 72 to an outlet fitting 74 on the top adjacent one end of an elongated horizontal water tank 76. Water enters the other end of the tank 76 through an inlet fitting 78 on the top thereof which is connected via flexible tubing 80 to a fitting 82 on a water pressure regulator 84. The pressure regulator 84 is provided with a water line connection 86 to a source of water under pressure. The pressure regulator is adapted to maintain the pressure of water supplied to the tank 76 in accordance with the regulator setting. In this regard, the regulator is provided with an adjustment wheel 88 that is in mesh with an externally accessible thumb wheel 90 at the rear of the base 14. The thumb wheel 90 may be operated to select a delivered water pressure over a substantial range, e.g., 20–45 lbs., to provide selected flow rates of water through the director members 34, 36 of 10–24 oz. per minute.

Figure 3:
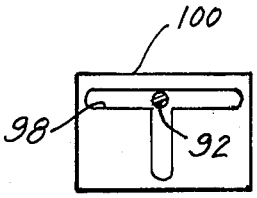
FIG. 3 is an end view of the plate with T-shaped slot for permitting mode selector movements in selected directions.

As previously indicated, blower operation does not occur while there is water movement. The supply of water to one or the other of the fore and aft nozzles, and the operation of the blower, are controlled via operation of a mode selector. In the illustrated arrangement, the mode selector comprises a rod 92 that extends through and is pivoted in a housing 93 mounted on the base 14 forward of the thumbwheel 90. The rod 92 is adapted, via a spring 94 connected between its inner end and a post or bracket 96, to act as a toggle. With reference to FIG. 3 along with FIGS. 1 and 2, the rod 92 extends through a T-shaped slot 98 in a plate 100. Thus arranged, the spring 94 normally positions the rod 92 in the center of the slot so that it can be moved along the top of the slot in either direction, or along the vertical leg of the slot, and to return immediately to the center when the outer end of the rod is released.

From its center position, and referring to FIG. 1, forward movement of the outer end of the mode selector rod 92 causes it to depress the plunger of a switch 102 which, as will be seen, effects operation of the diverter valve 66 so as to cause water to flow through the tube 68 to the front nozzle structure 38. Moving the outer end of the rod 92 to the rear causes it to depress the plunger of a switch 104 and effect water flow through the valve 66 to the rear nozzle structure through the tube 70. And upward movement of the outer end of the rod depresses the plunger of a switch 106 to operate the blower and cause heated air to be directed at the user. Thus, operation of the switch 106 cannot occur simultaneously with operation of either of the switches 102, 104.

Figure 11:
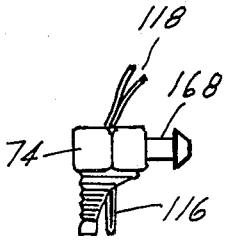
FIG. 11 is an elevation view, partly broken away, of the outlet fitting showing the temperature sensor supported therein.

Desired electrical operations include a water heater for heating the water that flows through the tank 76, a water temperature sensor for sensing the temperature of the water in the tank and effecting controlled heating by the heater to maintain the water temperature substantially constant, and a safety limit switch for cutting off and preventing further system operations in the event the temperature in the tank exceeds a predetermined level. The water heater element is shown at 110 in FIGS. 5 and 6, and is a typical high wattage sheathed heater of the Calrod type. The sensor is shown at 116 in FIG. 11 to be housed in the outlet fitting 74, and is provided with leads 118 for connection to a control module for monitoring the sensor resistance, and hence the temperature of the water. The control module is shown at 120 in FIG. 1 to be secured to the base 14. The over-temperature limit switch is shown at 122 in FIGS. 1, 6 and 7 to be threaded into the top of the tank 76.

Figure 5:
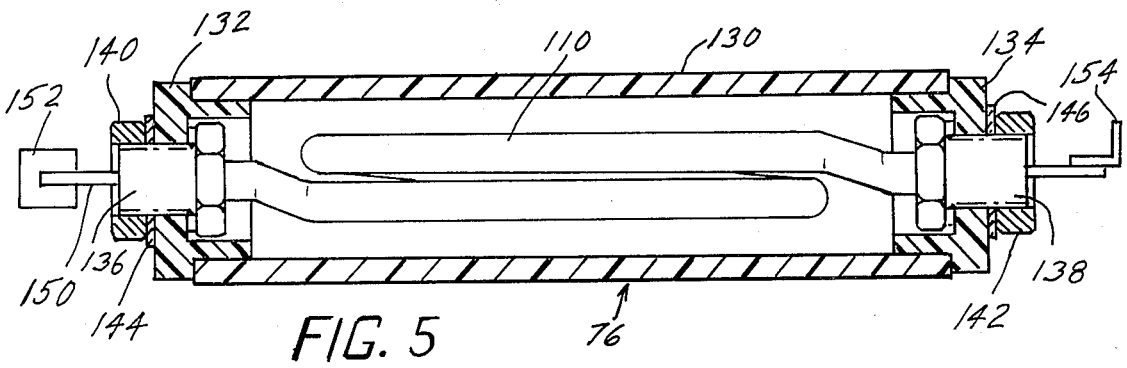
FIG. 5 is a fragmentary longitudinal sectional view of the water tank, such view being a horizontal section as viewed from above.
Figure 6:
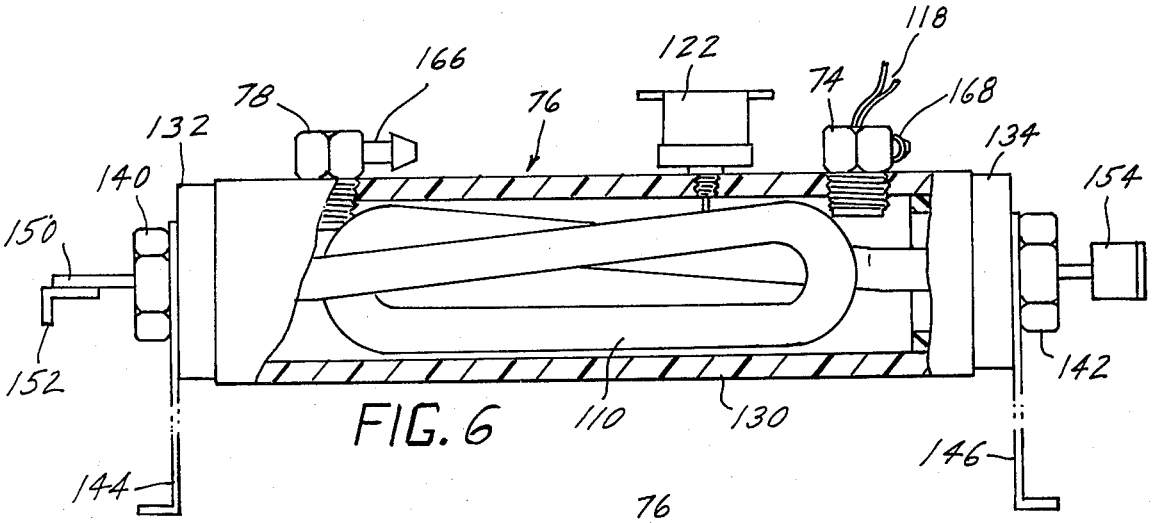
FIG. 6 is a fragmentary longitudinal sectional view of the water tank in a vertical plane, showing the inlet and outlet fittings, and thermal switch, secured to the top of the tank.

The needed electrical operations cannot take place without reliable control of water temperature. Therefore, an understanding of the structure, arrangement and functioning of the parts of the water tank, by which the temperature of the water in the tank is maintained the same throughout the tank, is essential. As shown in FIGS. 5 and 6, the tank 76 is formed of an elongated cylinder 130 with end caps 132, 134 secured therein, with the portions of the heater extending through the end caps being secured to them. For example, threaded sleeves 136, 138 secured to the ends of the sheath have flanges which engage the inner surfaces of the end caps 132, 134, and are clamped in such positions by external nuts 140, 142 threaded in place. In this example, mounting brackets 144, 146 for the tank are shown clamped between the nuts 140, 142 and the outer surfaces of the end caps 132, 134. The heater wire or rod 150 extending past the nuts 140, 142 has terminals 152, 154 welded to its ends.

Figure 7:
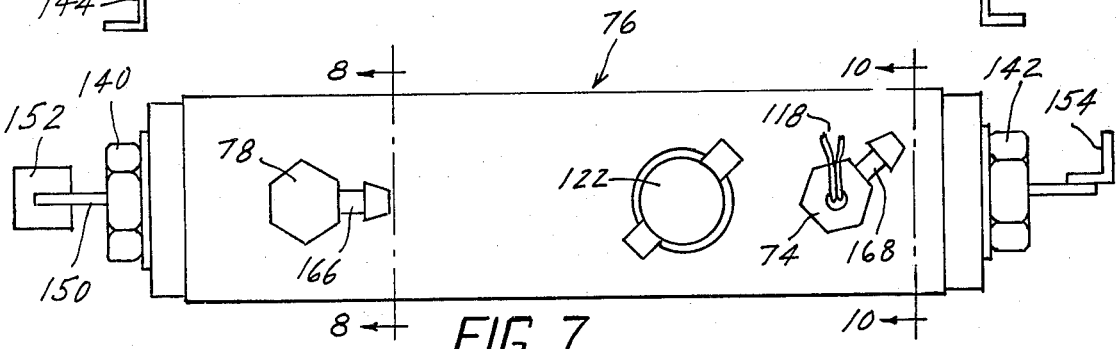
FIG. 7 is a top plan view of the tank and fittings.
Figure 8:
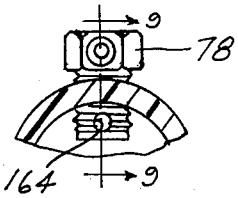
FIG. 8 is a fragmentary sectional view taken along the line 8—8 of FIG. 7.
Figure 10:
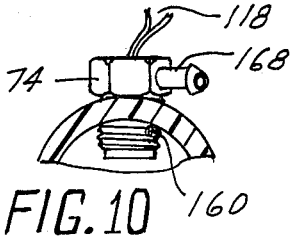
FIG. 10 is a fragmentary sectional view taken along the line 10—10 of FIG. 7.
Figure 9:
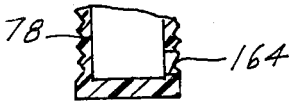
FIG. 9 is a fragmentary sectional view of the inlet fitting taken along the liner 9—9 of FIG. 8.

Referring to FIGS. 6, 7 and 10, the outlet fitting 74 is provided with a small opening 160 through its threaded wall, such fitting being threaded into place with the opening 160 positioned to just clear the inner surface of the cylinder 130. Referring to FIGS. 6–9, the inlet fitting 78 has its inner end closed (FIG. 9), and has an opening 164 through its threaded wall. The inlet fitting is secured in place with the opening 164 adjacent the inner surface of the cylinder 130, and facing the opposite end of the tank with the axis of the opening 164 approximately parallel to the axis of the cylinder.

In assembly, positioning of the fitting 78 with the opening 164 thus oriented is accomplished with the visual aid of an external stem 166 to which the flexible tube is attached for passing water from the pressure regulator to the tank. As illustrated, the stem 166 and opening 164 are on parallel axes. Thus, when the fitting 78 is threaded into the top of the tank, it is sufficient to view the interior of the cylinder to insure that the opening 164 is clear of the inner surface of the cylinder, and to sight with the stem 166 to approximate its orientation along a line parallel to the axis of the cylinder. In like fashion, a stem 168 extending from the outlet fitting 74 is a similar indicator of the direction in which the opening 160 is oriented.

Despite the ease with which the openings 160, 164 are properly oriented via sighting with the stems 166, 168, the positioning of such openings as above described is essential to insure that during water flow through the tank, the temperature of the water at the very top is the same as that at the bottom, at the center of the tank, and at any other location within the tank. In this regard, the opening 160 in the outlet fitting 74 is essential to effect immediate removal of air in the top of the tank upon the pressure regulator being operated to supply water flow to the inlet fitting 78, i.e., immediately with the start of water movement. Such air removal is also essential to insure that the sensor 116 will be exposed to water in the tank and not to superheated air.

Further, it has been found after extensive research and testing that the above described orientation of the opening 164 in the inlet fitting 78 is essential to effect such stirring during water flow as to cause water in all portions of the tank to be at the same temperature. It has also been found that such provisions make possible the maintenance within extremely close tolerance, e.g., 1°, of a predetermined temperature of water in the tank. Thus, in one bidet system with such a water tank construction, it has been easy to maintain the temperature during water flow so that the water directed against the user's skin is within 1° of 97.5° F.

Referring now to FIG. 4, a diverter valve solenoid and a pressure regulator solenoid are shown with primes of the numbers of the valve and regulator of FIG. 1, i.e., 66', 84'. In the unenergized condition of the diverter valve solenoid 66', the diverter valve 66 is conditioned to direct water to the rear nozzle structure 40. Thus, when a person on the seat is ready for a washing operation from the rear water stream, this is effected by moving the mode selector 92 to the rear and causes the switch 104 to operate and connect the pressure regulator solenoid so it is energized, whereupon water is supplied at constant pressure to water tank.

When a person first sits on the seat to close the pressure switch 26, the water in the tank may be far below a comfortable temperature. Such closing of the switch 26 permits current to flow through the heater 110 under control of the control module 120 until the water is preheated. In this regard, the control module and sensor are operative upon closure of the pressure switch, and the sensor resistance reflects the low temperature of the static water. The control module includes a comparison network in which the resistance of the sensor is compared to that of a network resistance, e.g., a potentiometer resistor, and effects a completed circuit through the water heater to permit it to be heated by current flow from the power source illustrated at 170 to which the plug 30 is connected. The control module interrupts the water heater circuit when a predetermined resistance differential is measured. This cut off is selected to allow for thermal coast, i.e., which is continued heating due to latent heat in the heating element. In practice, preheat cutoff is effected so the static water temperature in one example is slightly over 90° F.

When the person seated is ready to start a washing operation, movement of the mode selector to the rear operates the switch 104 and immediately effects water flow from the pressure regulator via energizing of the pressure regulator solenoid 84'. The diverter valve solenoid 66' remains unenergized, thus causing water flowing through the tank to pass through the diverter valve to the rear nozzle structure.

Simultaneously with the start of water flow through the tank, air trapped in the top of the tank is discharged through the outlet fitting and on out the rear nozzle structure. Also, immediately upon the cold source water entering the tank, the sensor 116 immediately causes the control module to sense a pressure differential in its comparison network of such magnitude as to close the water heater circuit and cause the water flowing in the tank to be heated. The heater is operable for a prolonged period due to the continual entry of cold water into the tank, and the heater heats such water rapidly enough that the water delivered to the skin of the user is kept within a degree of the temperature dictated by the network resistance comparisons, i.e., at or within a degree of 97.5° F. in one example.

However, substantially instantaneously upon release of the mode selector, the heater circuit is opened by the control module. In this regard, at the instant the mode selector is released, the sensor 116 may have a value such that the comparison network would permit continued current flow through the heater. However, the module 120 is adapted to respond to release of the mode selector, e.g., via a binary signal representing the return of the switch 104 to its normal condition (i.e., its disconnection from the module) to open the heater circuit and prevent further heating.

Such override is effected because of thermal coast. With no further water flow, the latent heat buildup in the heating element causes the static water in the tank to be heated after cutoff, with the result that such water reaches an elevated temperature well above the 97.5° F. needed for delivered water during water flow.

If the user decides to initiate further washing operation several seconds after releasing the mode selector, movement of the mode selector to the rear causes the above described solenoid and heater operations to resume. However, there is no "hot shot" noticed by the user. In this regard, when the previous washing operation ceased, another air bubble formed in the top of the tank between the two fittings 74, 78. When the mode selector was moved to repeat washing, the cooler water entering the tank effects immediate cooling of all water in the tank except the two or three drops captured in the outlet fitting. The air is instantly purged, of course, in the manner above described. Accordingly, the water movement that occurs includes water at the desired temperature of 97.5° streaming behind the minute quantity of overheated drops. The result is that the user's skin receives such drops followed by the large volume of cooler water, and there is no effect on the skin and no sensation to indicate the existence of such higher temperature drops. Thus, there is no "hot shot" to scald the skin or create any discomfort.

At the end of the washing operation, upward movement of the mode selector operates the switch 106 to cause the blower motor 60 and air heater 62 to be connected to the power source, and the accompanying warm air drying is maintained as long as desired. Such drying operation ceases immediately upon release of the mode selector and the return of the switch to its normal condition in which it disconnects the motor and heater from the power source.

Forward movement of the mode selector causes the switch 102 to close and connect power to the diverter valve solenoid 66', and simultaneously the pressure regulator solenoid 84' is connected to the power source via the switches 102, 104. Thus, the same water tank and temperature control of water flow as above described takes place, but with water supplied from the diverter valve 66 through the tube 68 to the front nozzle structure 38. Also, in the manner above described, release of the mode selector from the front position effects cutoff of heater operation upon the switch 102 being released to return to its normal condition. Thus, douching is readily accomplished via a douche nozzle (not shown) fitted to the front director 34.

As previously indicated, the system is cut off in the event of system failure, as in failure of the module to prevent heating when the desired temperature level of water is reached. For such a runaway condition, water heats rapidly to the temperature for opening the over-temperature thermal switch 122. The thermal switch 122 preferably is the type which will not reset until the bidet system parts are checked for repair and/or replacement. In one example, a suitable thermal switch for this purpose is a bimetallic switch that is normally closed, which opens at 120° F., and which will reset only when in an environment below 40° F. Such switches are commercially available, and serve in the instant case to keep an open circuit condition for the power circuits until the bidet unit is removed and returned to the manufacturer or service outlet. At such service station, the switch 122 can be reset, if desired, by putting it in a cold storage cabinet or any suitable freezer compartment in which the switch is exposed to a sufficiently low temperature to cause it to reset to a closed condition.

The sensor 116, and pressure regulator and diverter valve with solenoids, are also commercially available items, as are the switches shown and described herein. Similarly, the control module is of straightforward design for effecting the operations described, and is readily assembled with circuit elements connected in well known network arrangements to effect control of operations as above described.

The water tank described herein provides the described advantages for a comparatively small space. In one example, the tank is approximately 3-oz. of inner volume. The cylinder 130 is 5.0-inches long with a 1.0-inch inner diameter. The heater element 110 has a 0.25-inch diameter sheath, the length of which is about 12-in. within the tank, and its rating is 1,000 watts at 120 volts. It will be appreciated that such a heater coil occupies a substantial portion of the interior volume of the tank. The effectiveness of the water tank construction to achieve the needed mixing and temperature control is thus seen to be quite significant in the light of the foregoing parameters. In the inlet fitting 78, the opening 164 is a 0.125-in. diameter hole, and in the outlet fitting 74 the opening 160 is a 0.062-in. diameter hole. The hole 164 is located to clear the inner wall surface by approximately 0.062-in. to 0.125-in., and the hole 160 clears the inner wall by no more than 0.062-in. with the fitting 74 in the position shown.

We claim:

1. A bidet water handling system comprising:

a toilet seat housing having a central opening;

water outlet means in said housing through which to direct water into said opening from the rear thereof;

a horizontal water tank in said housing having an elongated inner cylindrical wall;

an inlet fitting extending vertically into the top lateral surface of said tank adjacent one end thereof;

said inlet fitting being closed at its inner end, said inlet fitting having a transverse opening directed parallel to the axis of said tank toward its other end and located adjacent the top of said wall;

means including a water pressure control means connected to said inlet fitting and a supply line in said housing for supplying water under pressure to said tank;

an outlet fitting extending vertically into the top lateral surface of said tank adjacent its other end;

means connecting said outlet fitting to said water outlet means;

and a heater in said tank adapted to heat the water flowing through said tank so as to supply heated water through said water outlet means, said outlet fitting having a transverse opening adjacent the top of said wall directed parallel to the axis of said tank in a direction away from the direction of flow from the opening in the inlet fitting, said opening in the outlet fitting functioning upon initiation of water flow to permit air in the top of the tank to be discharged through said water outlet means, and said opening in the inlet fitting functioning to cause water entering the tank to exert such stirring action as to make the water temperature the same in all portions of the tank.

2. The combination of claim 1, further including a temperature sensor in said outlet fitting extending into said tank, the inner end of said sensor being below the transverse opening in said outlet fitting; and means connected to said sensor and said heater to operate said heater for maintaining the water throughout said tank and passing through said water outlet means at a predetermined temperature.

3. The combination of claim 2, wherein said inlet and outlet fittings are threaded into the top of said tank, each of said inlet and outlet fittings having a respective external stem parallel to the axis of the transverse opening therein.

4. The combination of claim 2, further including second water outlet means for directing water into said opening from the front of said housing;

and means connecting said outlet fitting to said second water outlet means.

5. The combination of claim 4, wherein said connecting means includes a diverter valve with a connection to said outlet fitting and respective connections to said first-mentioned and said second water outlet means.

6. The combination of claim 5, further including a fitting housing an over-temperature therman switch and threaded vertically into the top lateral surface of said tank intermediate said inlet and outlet fittings;

and means connected to said thermal switch to prevent all operations if water temperature exceeds a predetermined level.

* * * * *